US010805760B2

(12) United States Patent
Doy et al.

(10) Patent No.: US 10,805,760 B2
(45) Date of Patent: Oct. 13, 2020

(54) ORIENTATION AWARE AUDIO SOUNDSTAGE MAPPING FOR A MOBILE DEVICE

(71) Applicant: Maxim Integrated Products, Inc., San Jose, CA (US)

(72) Inventors: Anthony Stephen Doy, Los Gatos, CA (US); Jonathan Chien, San Jose, CA (US); Robert Polleros, Sunnyvale, CA (US); Vivek Nigam, Dublin, CA (US); Sang Youl Choi, Santa Clara, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 6 days.

(21) Appl. No.: 15/216,623

(22) Filed: Jul. 21, 2016

(65) Prior Publication Data

US 2017/0026772 A1 Jan. 26, 2017

Related U.S. Application Data

(60) Provisional application No. 62/196,160, filed on Jul. 23, 2015.

(51) Int. Cl.
*H04S 7/00* (2006.01)
*H04S 1/00* (2006.01)

(52) U.S. Cl.
CPC ..... *H04S 7/308* (2013.01); *H04S 1/007* (2013.01); *H04R 2499/11* (2013.01)

(58) Field of Classification Search
CPC ..... H04S 7/308; H04S 7/302; H04S 1/007; H04R 2499/11; H04R 2499/15; H04R 2430/01; H04R 2430/20
(Continued)

(56) References Cited

U.S. PATENT DOCUMENTS 8,600,084 B1 12/2013 Garrett
2008/0069385 A1* 3/2008 Revit ..... H03G 5/025 381/321

(Continued)

FOREIGN PATENT DOCUMENTS

CN 10754082 A 6/2010
CN 102176765 A 9/2011

(Continued)

OTHER PUBLICATIONS

Office Action for Chinese Patent Application No. 201610840076.4 dated Oct. 25, 2019, (24 pgs).

(Continued)

*Primary Examiner* — Ahmad F. Matar
*Assistant Examiner* — Sabrina Diaz
(74) *Attorney, Agent, or Firm* — North Weber & Baugh LLP

(57) ABSTRACT

A mobile device with orientation aware audio mapping capability is disclosed. The mobile device has an aux speaker, a loud speaker, a sensor for device orientation detection, and a processor (or processors) coupled to the sensor and the speakers. Depending on the device orientation, the processor sends a mapped audio output to the speakers. The mapped audio output may be a mono audio signal or a stereo audio signal. The stereo audio output signal may be a stereo audio output signal with a balanced or biased audio power distribution between the aux speaker and the loud speaker.

11 Claims, 3 Drawing Sheets

(58) Field of Classification Search
USPC ..... 381/306, 333, 388
See application file for complete search history.

(56) References Cited

U.S. PATENT DOCUMENTS

2011/0316768 A1* 12/2011 McRae ..... H04R 5/02 345/156
2013/0230174 A1* 9/2013 Oliveras ..... H04R 5/04 381/17
2014/0079238 A1* 3/2014 Bastide ..... H04R 5/033 381/74
2014/0086415 A1* 3/2014 Sim ..... G06F 3/165 381/17
2014/0173667 A1* 6/2014 Koizumi ..... H04M 1/72597 725/62
2015/0181337 A1* 6/2015 Rodgers ..... H04R 5/02 381/304
2015/0372656 A1* 12/2015 Mow ..... H03H 7/38 455/77
2016/0142843 A1* 5/2016 Leschka ..... H04R 3/04 381/303
2016/0219392 A1* 7/2016 Vilermo ..... H04R 5/02

FOREIGN PATENT DOCUMENTS

CN 202602897 U 12/2012
CN 103167383 A 6/2013
CN 203734829 A 7/2014

OTHER PUBLICATIONS

CN Office Action No. 2 dated Aug. 4, 2020 in related Chinese Patent Application No. 201610840076.4, (23 pgs).

* cited by examiner

ORIENTATION AWARE AUDIO SOUNDSTAGE MAPPING FOR A MOBILE DEVICE

CROSS REFERENCE TO RELATED APPLICATION

The application claims priority under 35 U.S.C. § 119(e) to Provisional Application No. 62/196,160, entitled "Orientation Aware Audio Soundstage Mapping For A Mobile Device," listing as inventors, Anthony Stephen Doy, Jonathan Chien, Robert Polleros, Vivek Nigam, and Sang Youl Choi, and filed Jul. 23, 2015, the subject matter of which is hereby incorporated herein by reference in its entirety.

BACKGROUND

A. Technical Field

The present invention relates generally to an orientation aware audio mapping method for mobile devices.

B. Background of the Invention

Modern mobile devices have been used widely for various applications, such as telecommunications, media playing, etc. Most mobile devices have at least one speaker to play audio signals. Some mobile devices, such as smartphones, have at least an ear speaker (or auxiliary speaker) for phone communications and a loud speaker for hand-free phone or media playing purposes.

Most phones have audio management processes that control the structure and method in which audio signals are processed and subsequently used to generate sound for a user. For example, typical phones will turn off any auxiliary speaker when the loud speaker is operating. As a result, the phone is in a "mono sound" mode (monophonic reproduction) when the phone is operating in loud speaker mode. When a phone user is playing a file with stereo sound content, the user may only be able to enjoy restricted or limited sound features of the program material in the loud speaker mode.

Modern smartphones or tablet electronic devices typically have built-in sensors for orientation awareness, which enable the smartphones or tablets to respond dynamically for changing device orientation. The dynamic responding actions are typically focused on the area of displaying orientation, such as changing displaying direction between portrait and landscape orientations.

It would be desirable to have a mobile device having an orientation aware stereo audio mapping capability for enhanced user experiences.

SUMMARY OF THE INVENTION

Embodiments of the invention relate to a mobile device with orientation aware audio mapping capability and method for its implementation.

In various embodiments, a mobile device with orientation aware audio mapping capability is disclosed. The mobile device has an auxiliary (hereinafter, aux) speaker, a loud speaker, a sensor for device orientation detection, and a processor coupled to the sensor and the speakers. The aux speaker may be that used for "close the ear" listening during phone calls (sometimes referred to as the receive speaker). Depending on the device orientation, the processor sends a mapped audio output to the speakers. The mapped audio output may be a mono audio signal or a stereo audio signal. The stereo audio output signal may be a stereo audio output signal with a balanced audio power distribution between the aux speaker and the loud speaker. The stereo audio output signal may also be a stereo audio output signal with a biased audio power distribution between the aux speaker and the loud speaker. The bias setting may be pre-set or set dynamically by the user according to the user's preference and/or the characteristics of the audio signals. A similar mapping option would apply to mono source material.

In one embodiment, the processor of the mobile device couples to the sensor and the speakers via a crossover. The processor outputs a stereo audio signal output comprising a left channel (hereinafter, "L-channel") and a right channel (hereinafter, "R-channel"), which are passed through the crossover. The crossover may divide the stereo audio signal output from the processor into 4 channels of audio signals: Llp (left channel low pass), Lhp (left channel high pass), Rlp (right channel low pass) and Rhp (right channel high pass). These 4 channels of audio signals are then distributed across the two speakers with a desired combination as dictated by the processor with device orientation inputs. In some embodiments, the auxiliary speaker only receives a combination of Lhp and Rhp channel signals.

In one embodiment, the mobile device comprises an audio socket for exporting the audio signal to an audio earphone accessory. The processor of the mobile device is also coupled to the audio socket. In one embodiment, upon detection audio jack insertion, the microprocessor bypasses the crossover and sends the stereo audio output signals directly to the audio earphone accessory via the audio socket. In another embodiment, the microprocessor does not bypass the crossover and sends the processed stereo audio output signals to the audio earphone accessory via the crossover.

BRIEF DESCRIPTION OF THE DRAWINGS

Reference will be made to exemplary embodiments of the present invention that are illustrated in the accompanying figures. Those figures are intended to be illustrative, rather than limiting. Although the present invention is generally described in the context of those embodiments, it is not intended by so doing to limit the scope of the present invention to the particular features of the embodiments depicted and described.

One skilled in the art will recognize that various implementations and embodiments of the invention may be practiced in accordance with the specification. All of these implementations and embodiments are intended to be included within the scope of the invention.

DETAILED DESCRIPTION OF THE PREFERRED EMBODIMENTS

In the following description, for the purpose of explanation, specific details are set forth in order to provide an understanding of the present invention. The present invention may, however, be practiced without some or all of these details. The embodiments of the present invention described below may be incorporated into a number of different electrical components, circuits, devices, and systems. Structures and devices shown in block diagram are illustrative of exemplary embodiments of the present invention and are not to be used as a pretext by which to obscure broad teachings of the present invention. Connections between components within the figures are not intended to be limited to direct connections. Rather, connections between components may be modified, re-formatted, or otherwise changed by intermediary components.

When the specification makes reference to "one embodiment" or to "an embodiment", it is intended to mean that a particular feature, structure, characteristic, or function described in connection with the embodiment being discussed is included in at least one contemplated embodiment of the present invention. Thus, the appearance of the phrase, "in one embodiment," in different places in the specification does not constitute a plurality of references to a single embodiment of the present invention.

Various embodiments of the invention are used for a mobile device with orientation aware audio mapping capability and methods for its implementation. The mobile device has an aux speaker, a loud speaker, a sensor for device orientation detection, and a processor coupled to the sensor and the speakers. Depending on the device orientation, the processor sends a mapped audio output to the speakers. The mapped audio output may be a mono audio signal or a stereo audio signal.

Figure 1:
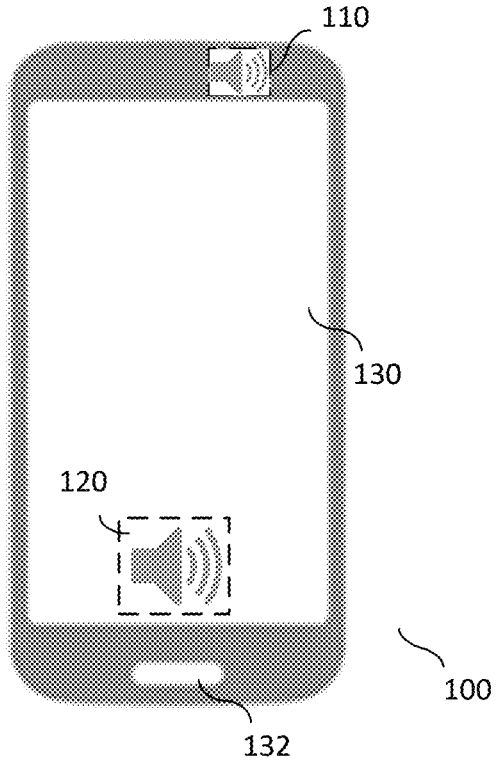
FIG. 1 Prior Art
FIG. 1 is a schematic diagram of a mobile device with a loud speaker and an aux speaker.

FIG. 1 shows a schematic diagram of a prior art mobile device with a loud speaker and an auxiliary speaker. The mobile device 100 may be a smart phone or a tablet device having a receive speaker (or aux speaker) 110, a loud speaker 120 and an I/O (input/output) interface 130. The I/O interface may be a touch screen functioning both as an input and an output. Additionally, the mobile device 100 may have an additional input 132 for receiving user input. The additional input 132 may be one or more physical buttons for various functionalities, such as home button, volume up/down, mute, etc.

The aux speaker 110 and the loud speaker 120 are typically positioned on opposite ends of the mobile device 110. For a smart phone type mobile device, the aux speaker 110 is mainly used for phone conversations in a private manner and thus has a lower audio power ratio compared to the loud speaker 120. The loud speaker 120 is used for hands-free phone conversations and for audio signal output when the mobile device 100 is playing a media file.

Traditionally, some phones may have the aux speaker turned off when the loud speaker is ON. As a result, the phone is in a "mono sound" mode when the phone is operating the loud speaker (in loud speaker mode). When a phone user is playing a file with stereo sound contents, the user may only be able to enjoy restricted or limited sound features of the file in the loud speaker mode. Furthermore, modern smart phones or tablet electronic devices typically have built-in sensors for device orientation awareness, which enable the mobile device to respond dynamically or accordingly for different device orientation. The responding actions are typically focused on the area of displaying orientation, such as changing displaying direction between portrait and landscape orientations, displaying an image or video images full screen under landscape orientation, etc.

Figure 2:
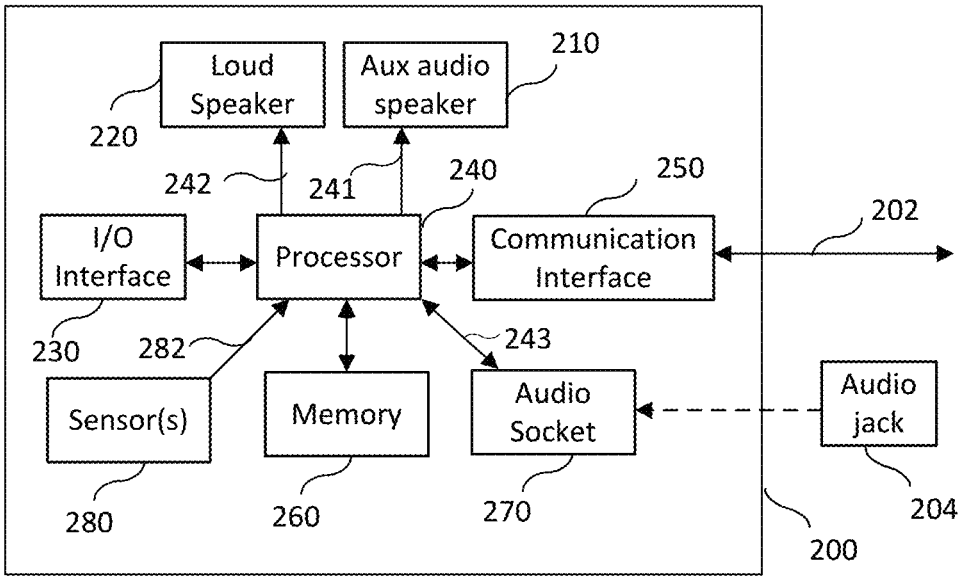
FIG. 2 is an exemplary block diagram of a mobile device with orientation aware audio mapping capability according to various embodiments of the invention.

FIG. 2 is an exemplary block diagram of a mobile device with orientation aware audio mapping capability according to various embodiments of the invention. The mobile device 200 comprises an ear speaker (or aux speaker) 210, a loud speaker 220, an I/O (input/output) interface 230, a communication interface 250, a memory 260, an audio socket 270, a sensor 280 and a processor 240 coupled to the aforementioned components. The mobile device 200 may also comprise other components not shown in FIG. 2, such as a power source, or additional input (physical buttons for various functionalities, such as home button, volume up/down, mute, etc.). The processor 240 receives a device orientation signal 282 from the sensor 280 and sends a first orientation dependent audio output signal 241 and a second orientation dependent audio output signal 242 to the aux speaker 210 and the loud speaker 220 respectively. In some embodiments, upon detection of an audio jack 204 insertion into the audio socket 270, the processor 240 stops sending any audio output signals to the speakers and starts sending an audio output signal 243 to the audio socket 270. The audio output signal 243 may or may not be device orientation dependent.

In one embodiment, when the mobile device is in a portrait orientation (or the aux speaker and loud speaker in an up-down or down-up position), the first orientation dependent audio output signal 241 to the aux speaker 210 and the second orientation dependent audio output signal 242 to the loud speaker 220 are the same. Therefore, the aux speaker and the loud speaker are operated in an overall mono audio mode, with the sum of acoustic signal being that of both the aux and the loudspeaker combined. Several different gain and crossover settings can be conceived to achieve this. When the mobile device is in a landscape orientation (or the aux speaker and loud speaker in a left-right or right-left position), the first orientation dependent audio output signal 241 to the aux speaker 210 and the second orientation dependent audio output signal 242 to the loud speaker 220 form a stereo audio signal. Thus, the aux speaker and the loud speaker are operated in a stereo audio mode.

In some embodiment, the aux speaker and the loud speaker may be operated in a balanced or biased stereo audio mode. A user of the mobile device may customize the stereo audio mode by setting different gains (dBs) to the first orientation dependent audio output signal 241 to the aux speaker 210 and the second orientation dependent audio output signal 242 to the loud speaker 220. The user may implement the setting via the I/O (input/output) interface 230 through an app stored within the memory 260. The ability to customize stereo audio mode may provide additional convenience to users with special needs.

Referring to FIG. 2, the processor 240 may be a system on chip (SoC) integrated circuit, a microprocessor, a microcontroller, or other types of integrated circuits. It may contain digital, analog, mixed-signal, and often radio-frequency functions. The memory 260 is a non-volatile storage device storing computer readable control logics or codes and other user data. The control logics or codes are accessible and executable by the processor 240. In some embodiment, the processor 240, the memory 260 and other volatile memory (RAM) may be integrated into a single module or component. The sensor 280 is an orientation sensor to sense the mobile device orientation. The sensor 280 may comprise an accelerometer, a gyroscope and/or a magnetometer to sense an actual 2 or 3-dimensional space orientation.

Figure 3:
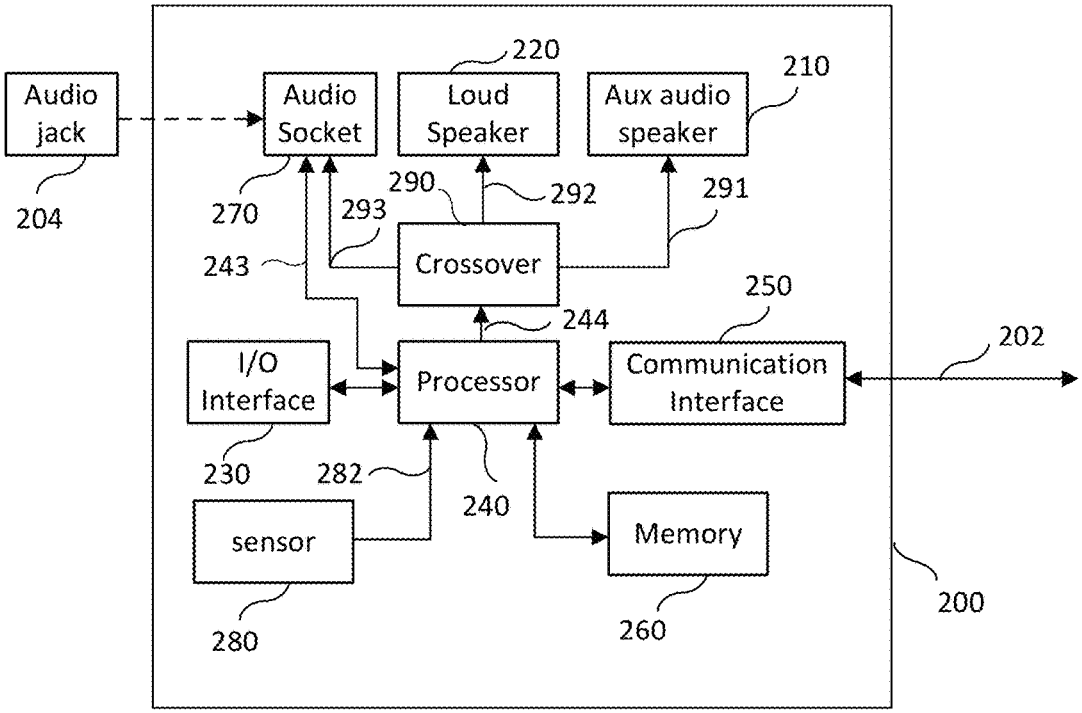
FIG. 3 is another exemplary block diagram of a mobile device with orientation aware audio mapping capability according to various embodiments of the invention.

FIG. 3 is another exemplary block diagram of a mobile device with orientation aware audio mapping capability according to various embodiments of the invention. Compared to FIG. 2, FIG. 3 has an additional crossover 290 coupled between the processor 240 and a group of the aux speaker 210, the loud speaker 220 and the audio socket 270. The processor 240 receives a device orientation signal 282 from the sensor 280 and sends an audio output signal 244 to the crossover 290. The audio output signal 244 may be a stereo audio signal comprising an L-channel signal and an R-channel signal. The audio output signal 244 may or may not be device orientation dependent. The crossover 290 receives the audio output signal 244 and sends a first orientation dependent audio output signal 291 to the aux speaker 210 and a second orientation dependent audio output signal 292 to the loud speaker 220.

In some embodiments, the crossover 290 couples to the audio socket 270 and upon audio jack 204 insertion detected, sends a third audio output signal 293 to the audio socket 270 (and stops sending any audio output signals to the speakers). The audio output signal 293 may or may not be device orientation dependent. In some embodiments, the processor 240 couples to the audio socket 270 and upon audio jack insertion detected, sends an audio output signal 243 to the audio socket 270 directly (by pass the crossover). The audio output signal 243 may be the same as or different from the audio output signal 244 sent to the crossover 290. The audio output signal 243 may or may not be device orientation dependent.

Figure 4:
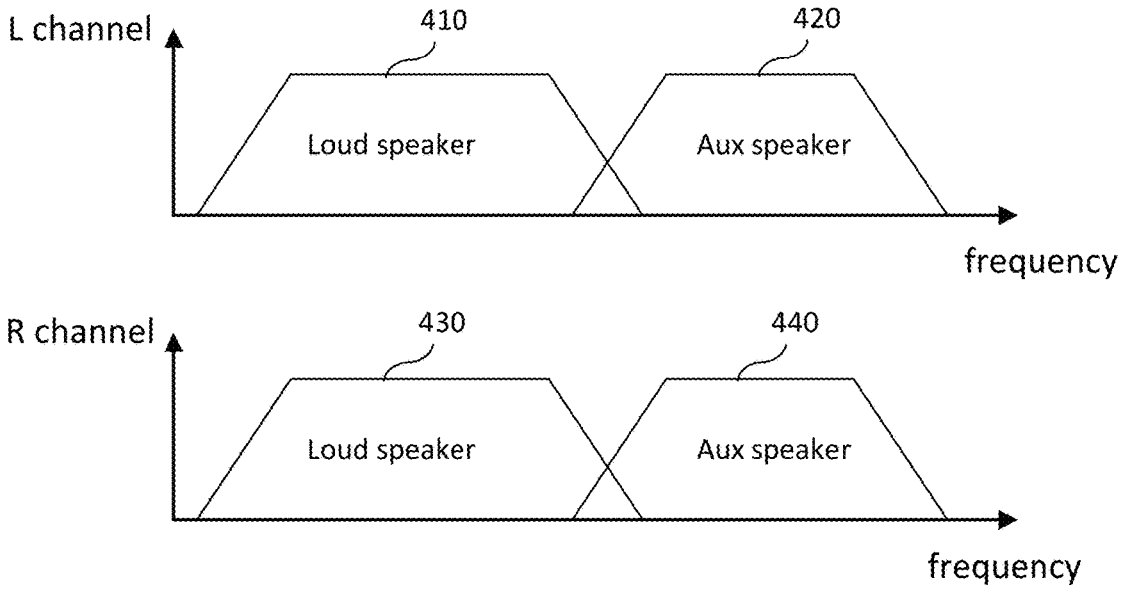
FIG. 4 is an exemplary diagram of a crossover dividing a stereo audio signal output from the processor into 4 channels of audio signals according to various embodiments of the invention.

FIG. 4 shows an exemplary diagram of a crossover dividing a stereo audio signal output from the processor into 4 channels of audio signals according to various embodiments of the invention. The crossover 290 divides the audio signal output 244 from the processor 240 into 4 channels: an Llp (left channel low pass) audio signal 410, an Lhp (left channel high pass) audio signal 420, an Rlp (right channel low pass) audio signal 430 and an Rhp (right channel high pass) audio signal 440. These 4 channels of audio signals are then distributed across the two speakers with a desired combination as dictated by the processor 240 according to the input of the device orientation. In one embodiment, the Llp signal 410 and the Rlp 430 correspond to audio frequency below 1000 Hz; the Lhp signal 420 and the Rhp 440 correspond to audio frequency above 1000 Hz. In one embodiment, the Llp signal 410 and the Rlp 430 correspond to audio frequency below 4000 Hz; the Lhp signal 420 and the Rhp 440 correspond to audio frequency above 4000 Hz. In one embodiment, the audio frequency band corresponding to the Llp signal 410 and the Rlp 430 has overlap with the audio frequency band corresponding to the Lhp signal 420 and the Rhp 440.

In one embodiment, when the mobile device is in a portrait position, both the Llp signal 410 and Rlp signal 430 are sent to the loud speaker 220; both the Lhp signal 420 and Rhp signal 440 are sent to the aux speaker 210 (as shown in FIG. 4). The loud speaker 220 and the aux speaker 210 are operated like a pair of bookshelf speakers, with each speaker responding to a certain audio frequency band. In another embodiment, when the mobile device is in a landscape position, both the Llp signal 410 and Lhp signal 420 are sent to the loud speaker 220; both the Rlp signal 430 and Rhp signal 440 are sent to the aux speaker 210. The loud speaker 220 and the aux speaker 210 are operated like a pair of stereo speakers, with each speaker responding to a left or right channel audio signal. In yet another embodiment, the Llp signal 410, Lhp signal 420 and the Rlp signal 430 are sent to the loud speaker 220; only the Rhp signal 440 is sent to the aux speaker 210. The loud speaker 220 and the aux speaker 210 are operated like a hybrid between stereo speakers and bookshelf speakers.

Although only two audio frequency bands are used to divide the stereo audio signals as shown in FIG. 4, it is understood that more frequency bands, such as low, mid-range and high bands, may be used to divide the stereo audio signals, and various other distribution schemes may be implemented to distributed the divided audio signals across the two speakers (or even more speakers). Such variations are still within the scope this invention.

Figure 5:
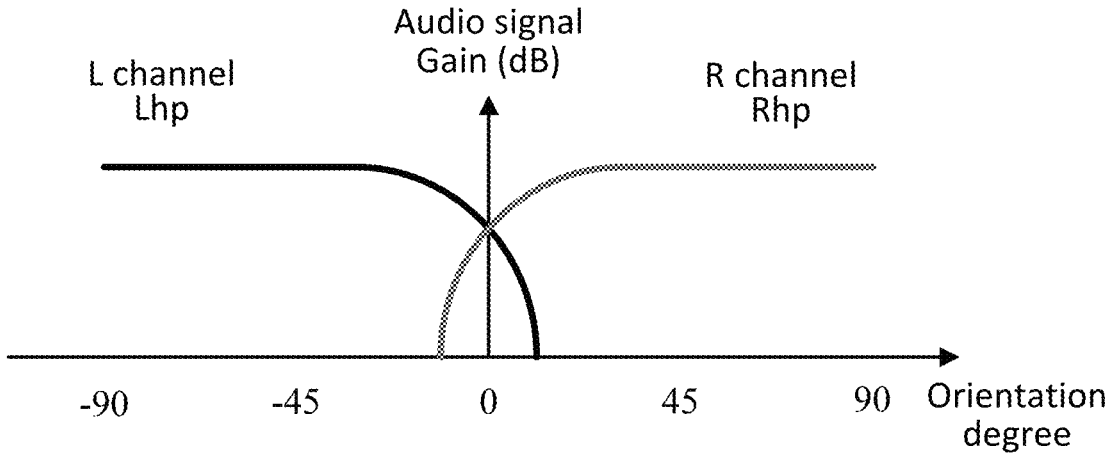
FIG. 5 is an exemplary diagram of audio signal gains at various mobile device orientation angles according to various embodiments of the invention.

FIG. 5 shows an exemplary diagram of audio signal gains at various mobile device orientation angles according to various embodiments of the invention. In FIG. 5, the Lhp signal 420 and the Rhp signal 440 are implemented with audio gains at various mobile device orientation angles. At 0° degree wherein the aux speaker and the loud speaker are in a left-right horizontal layout (or the mobile device is in a landscape position), the Lhp signal 420 and the Rhp signal 440 have the same gain. At 90° degree wherein the aux speaker and the loud speaker are in an up-down vertical layout, the Lhp signal 420 has zero gain and the Rhp signal 440 has a maximum gain. At −90° degree wherein the aux speaker and the loud speaker are in a down-up vertical layout, the Lhp signal 420 has maximum gain and the Rhp signal 440 has a zero gain. The gain for the Lhp signal 420 decreases gradually to zero at a degree between 0° degree and 45° degree. The gain for the Rhp signal 440 decreases gradually to zero at a degree between −45° degree and 0° degree.

At 0° degree device orientation, the Lhp signal 420 and the Rhp signal 440 have the same gain and are summed together to fed to the aux speaker. In some embodiment, the Lhp signal 420 and the Rhp signal 440 have different gain at 0° degree. The different in gain may be set by a user via the I/O interface 230 through an app stored within the memory 260. Similarly, a user may also set different maximum gains for the Lhp signal 420 and the Rhp signal 440 via the I/O interface 230.

Although FIG. 5 only shows gains of the Lhp signal 420 and the Rhp signal 440, various other audio gain schemes may be implemented for the Lhp signal 420, the Rhp signal 440 or other audio signals not shown in FIG. 5, such as Llp signal 410 and Rlp signal 430. The gain variation for different audio signals can be implemented separately or in combination with the aforementioned stereo audio division/distribution method for various device orientation aware audio mappings.

Figure 6:
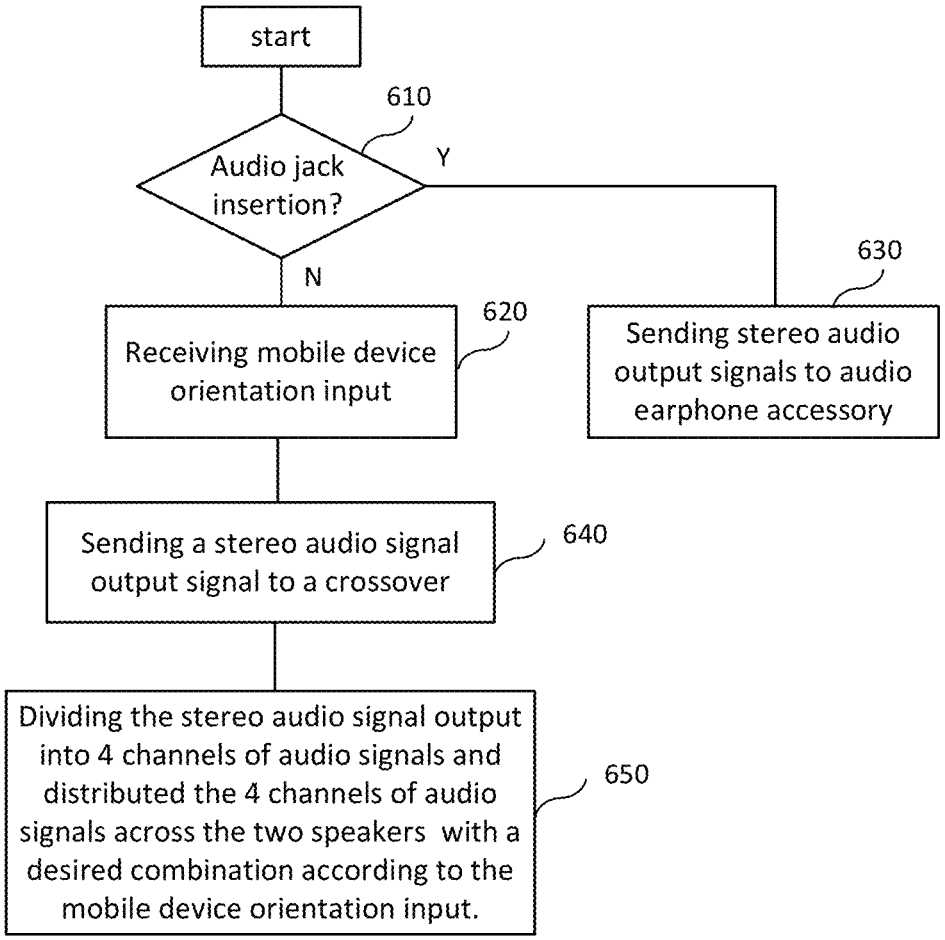
FIG. 6 is flow diagram of orientation aware audio mapping of a mobile device according to various embodiments of the invention.

FIG. 6 is flow diagram of orientation aware audio mapping process of a mobile device according to various embodiments of the invention. At step 610, audio jack insertion into the socket is checked. If not, the process goes to step 620 for receiving mobile device orientation input from the sensor 280. If yes, the process goes to step 630 for sending stereo audio output signals to an audio earphone accessory via the audio socket. At step 640, a stereo audio signal output signal is sending to a crossover. At step 650, the stereo audio signal output is divided into 4 channels of audio signals and the 4 channels of audio signals are distributed across the two speakers with a desired combination according to the mobile device orientation input.

Although FIG. 6 is shown with the exemplary flow diagram for a mobile device orientation aware audio mapping, it is understood that various modification may be applied for the flow diagram. The modification may include excluding certain steps and/or adding additional steps, parallel steps, different step sequence arrangements, etc. For example, audio jack insertion may happen anytime during the process. Once audio jack insertion detected, the processor starts sending stereo audio output signals to audio earphone accessory.

The foregoing description of the invention has been described for purposes of clarity and understanding. It is not intended to limit the invention to the precise form disclosed. Various modifications may be possible within the scope and equivalence of the application.

The invention claimed is:

1. A method for audio mapping of a mobile device, the method comprising:

upon detecting no audio accessory insertion to an audio socket in the mobile device, receiving a device orientation signal indicating a mobile device orientation angle;

dividing an audio signal output into one or more channels of audio signals;

implementing audio gains to the one or more channels of audio signals respectively based at least on the device orientation signal, each channel of audio signal has an audio gain up to a user-settable maximum gain, the audio gain of at least one channel gradually changes as the mobile device orientation angle changes; and distributing the one or more channels of audio signals with audio gains across one or more speakers within the mobile device based at least on the mobile device orientation angle.

2. The method of claim 1 wherein the audio output signal is a stereo audio signal comprising an L-channel signal and an R-channel signal.

3. The method of claim 2 wherein the one or more channels of audio signals comprise a left channel low pass (Llp) signal, a left channel high pass (Lhp) signal, a right channel low pass (Rlp) signal, and a right channel high pass (Rhp) signal.

4. The method of claim 3 wherein the one or more speakers comprise a loud speaker and an aux speaker.

5. The method of claim 4 wherein when the mobile device is in a portrait position, both the Llp signal and Rlp signal are sent to the loud speaker, both the Lhp signal and Rhp signal are sent to the aux speaker.

6. The method of claim 4 wherein when the mobile device is in a landscape position, both the Llp signal and Lhp signal are sent to the loud speaker, both the Rlp signal and Rhp signal are sent to the aux speaker.

7. The method of claim 1 further comprising upon detecting the audio accessory insertion to the audio socket of the mobile device, sending a device orientation-independent audio output signal to the audio accessory via the audio socket.

8. A method for orientation based audio mapping of a mobile device, the method comprising:

upon detecting no audio accessory insertion to an audio socket in the mobile device, receiving a device orientation signal indicating a mobile device orientation angle;

dividing an audio signal output into one or more channels of audio signals;

implementing audio gains to the one or more channels of audio signals respectively based at least on the mobile device orientation angle, each channel of audio signal has an audio gain up to a user-settable maximum gain, the audio gain of at least one channel gradually changes as the mobile device orientation angle changes;

sending, based at least on the mobile device orientation angle, the one or more channels of audio signals with audio gains to at least one speaker of a loud speaker and an aux speaker within the mobile device.

9. The method of claim 8 wherein the one or more channels of audio signals comprise a left channel low pass (Llp) signal, a left channel high pass (Lhp) signal, a right channel low pass (Rlp) signal, and a right channel high pass (Rhp) signal.

10. The method of claim 9 wherein when the mobile device orientation angle is 0 degree with the aux speaker and the loud speaker in a left-right horizontal layout, the Lhp signal and the Rhp signal have the same audio gain, the Llp signal and the Rlp signal have the same audio gain, the gained Llp signal and gained Lhp signal being distributed to the aux speaker, the gained Rlp signal and gained Rhp signal being distributed to the loud speaker.

11. The method of claim 9 wherein when the mobile device orientation angle is 90 degree with the aux speaker and the loud speaker in an up-down vertical layout, the Lhp signal has zero gain and the Rhp signal has a maximum gain, the Llp signal has zero gain and the Rlp signal has a maximum gain, the gained Rhp signal being distributed to the aux speaker, the gained Rlp signal being distributed to the loud speaker.

* * * * *